United States Patent [19]

Lee

[11] Patent Number: 4,708,688

[45] Date of Patent: Nov. 24, 1987

[54] SKIING TOY

[76] Inventor: Chung-Cheng Lee, No. 31, Show Shan Road, Dan Feng Lee, Shing Chung, Taipei, Taiwan

[21] Appl. No.: 877,067

[22] Filed: Jun. 23, 1986

[51] Int. Cl.[4] ..... A63H 11/10

[52] U.S. Cl. ..... 446/288; 446/290; 446/292

[58] Field of Search ..... 446/288, 289, 290, 292, 446/293, 294

[56] References Cited

U.S. PATENT DOCUMENTS

| | | | |
|---|---|---|---|
| 2,248,214 | 7/1941 | Bleeker | 446/288 |
| 2,566,141 | 8/1951 | Poli | 446/288 |
| 2,839,302 | 6/1958 | Almoslino | 446/289 X |
| 4,422,261 | 12/1983 | Kozuka et al. | 446/290 |

FOREIGN PATENT DOCUMENTS

| | | | |
|---|---|---|---|
| 459981 | 6/1951 | Italy | 446/289 |
| 602365 | 2/1960 | Italy | 446/288 |

*Primary Examiner*—Kenneth J. Dorner
*Assistant Examiner*—Peter Brown
*Attorney, Agent, or Firm*—Armstrong, Nikaido, Marmelstein & Kubovcik

[57] ABSTRACT

A toy having an upright toy body standing on a pair of skis to resemble a skier. Each ski is provided with a driving wheel operable by an electric motor in cooperation with a driving mechanism built within the toy body to rotate so as to enable the toy to roll on a ground surface. The toy has two hands each holding a ski pole, the two hands being operable by the same electric motor in cooperation with an alternating pivot lever to move alternatingly up-and-down while the driving wheels are caused to rotate. The up-and-down movement of the two hands causes the ski poles to alternatingly push the ground to cause the toy body to alternatingly tilt sidewardly, thus causing the driving wheels to lift alternatingly from the ground; as a result the toy turns alternatingly along a zig-zag course while it rolls, as if a skier were skiing along a zig-zag course.

2 Claims, 8 Drawing Figures

SKIING TOY

BACKGROUND OF THE INVENTION

This invention relates to a movable toy, more particularly to a skiing toy that is electrically operable to perform a skiing motion.

A variety of movable toys, including those resembling walking animals, playing clowns as well as combat robots, are available. However, there has never been a toy that is capable of performing a skiing motion, particularly a skiing motion along a zig-zag course.

Therefore it is a primary object of the present invention to provide a movable toy that is electrically operable to perform a skiing motion along a zig-zag course.

SUMMARY OF THE INVENTION

This invention presents a skiing toy, which consists of an upright toy body resembling a skier that may be a man or an animal, the toy body having two legs standing on a pair of skis and two hands holding a pair of ski poles. Each ski is provided with a driving wheel and a lead wheel so as to enable the whole toy unit to roll over a ground surface. Built within the toy body are a driving mechanism operable by an electric motor to cause the driving wheels to rotate, and an alternating device operable by the same electric motor to cause the two hands of the toy to move alternatingly up-and-down. The rotating driving wheels cause the whole toy to roll in a straight direction when the lower ends of both ski poles are not in contact with the ground. The alternatingly moving hands cause the pair of ski poles to alternatingly push the ground; when one (first) ski pole is caused to push the ground, the toy body is caused to tilt sidewardly toward the opposite (second) side, causing the driving wheel of the ski of the same (first) side to lift from the ground, and the toy is caused to roll by the driving wheel of the ski of the opposite (second) side, so as to cause the toy to turn and roll toward the first side. As soon as the ski pole of the opposite side is caused to push the ground while the ski pole of the first side is caused to lift from the ground, the toy is caused to roll towards the opposite side. As a result the toy rolls along a zig-zag course.

DETAILED DESCRIPTION OF THE INVENTION

Figure 5:
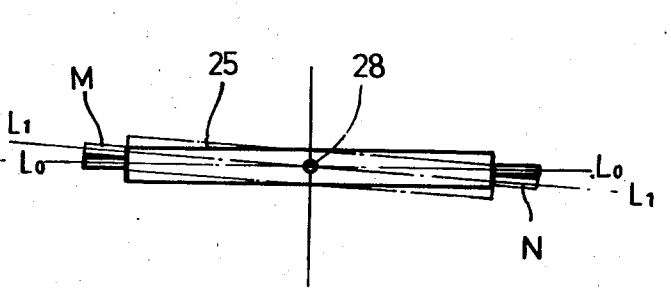
FIG. 5 is a schematic illustration showing the pivotal movement of the pivot lever employed in the toy of this invention.

The skiing toy of this invention will now be described in detail with reference to the embodiment shown in the drawings.

Figure 1:
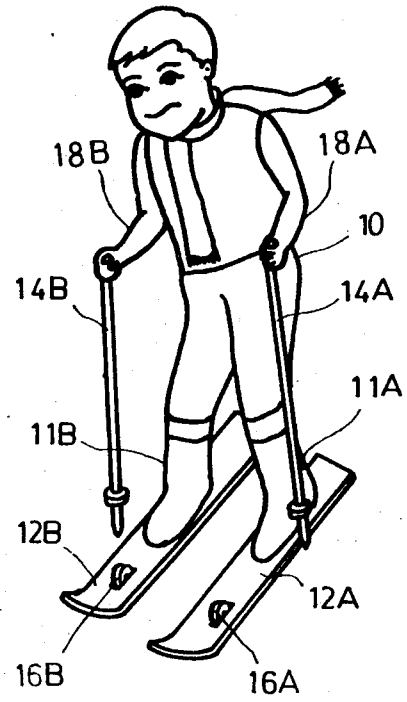
FIG. 1 is a perspective view of the skiing toy of this invention, showing its general appearance.

As shown in FIG. 1, the skiing toy of this invention generally consists of an upright toy body 10 resembling a skier, the toy body 10 having two legs 11A, 11B standing on a pair of elongated flat members resembling a pair of skis 12A, 12B, two hands 18A, 18B holding a pair of elongated rod members resembling a pair of ski poles 14A, 14B.

Figure 2:
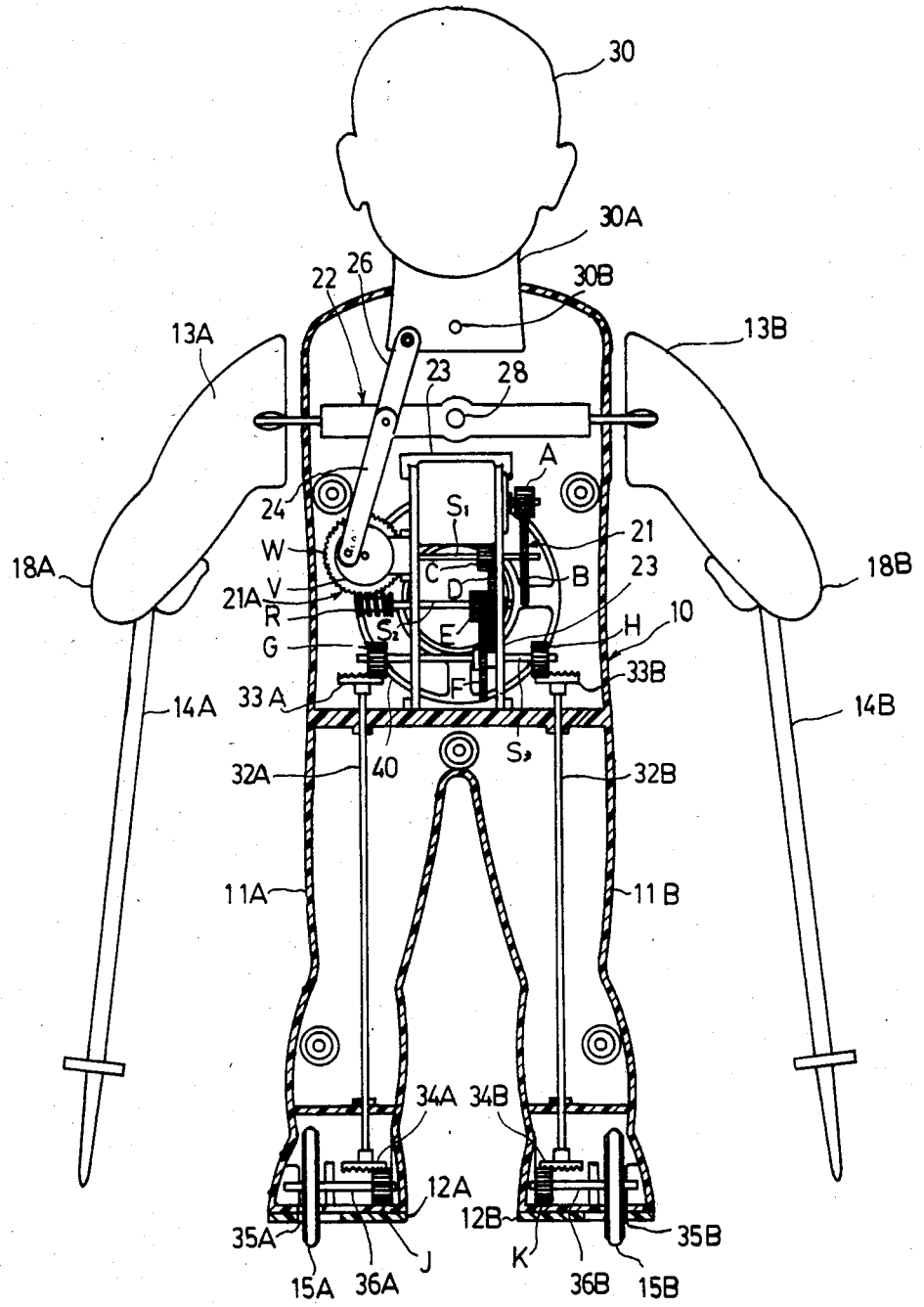
FIG. 2 is a vertical cross sectional view of the skiing toy of this invention, viewed from the back side of the toy.
Figure 3:
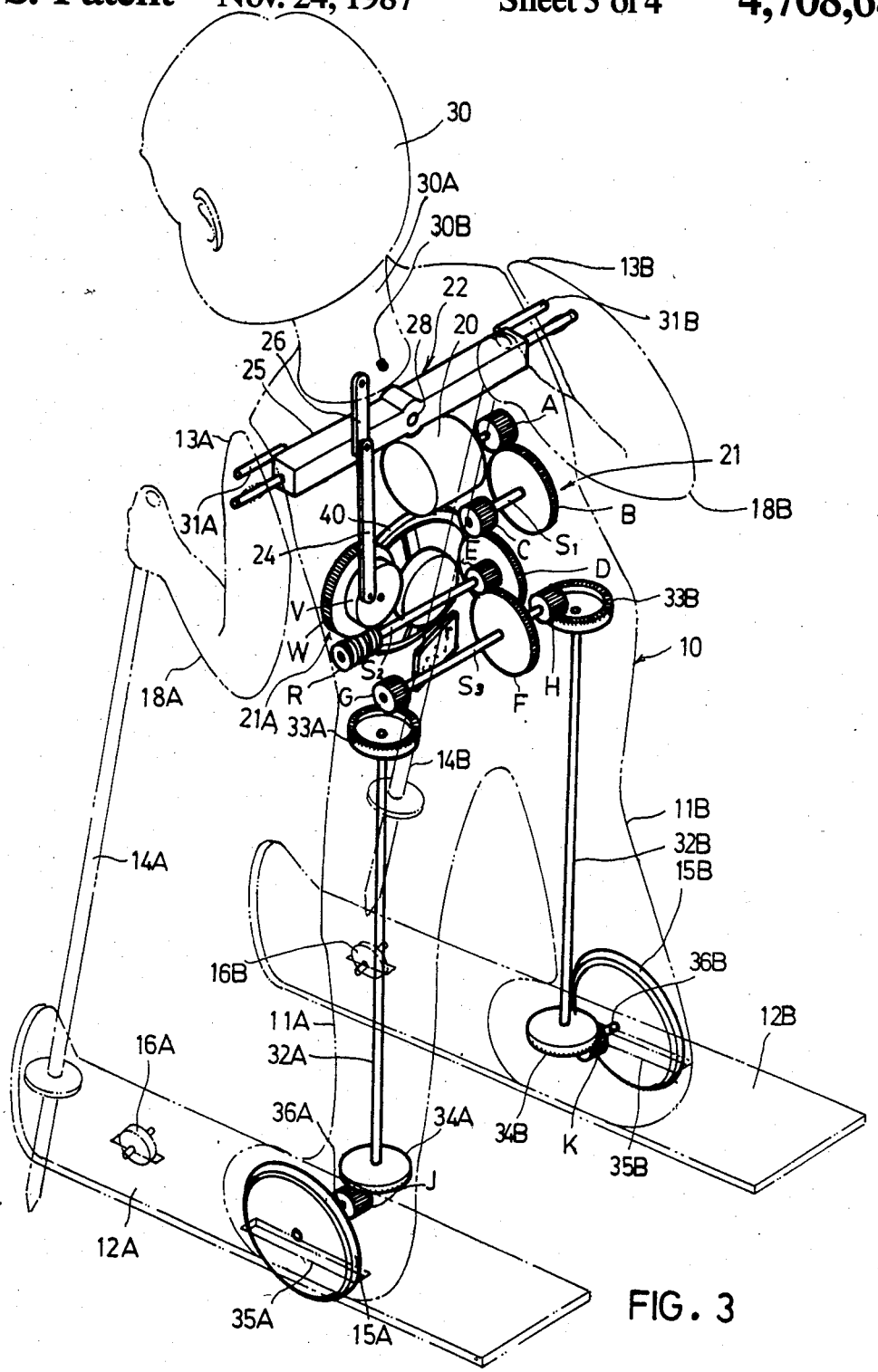
FIG. 3 is a schematic perspective drawing showing the arrangemen of the driving mechanism employed in the skiing toy of FIG. 2.

As shown in FIG. 3, each ski 12A or 12B, is provided with a driving wheel 15A or 15B, and a lead wheel 16A or 16B to maintain the stability of the toy when rolling. Toy body 10 has two L-shaped hands 18A, 18B, mounted at their upper ends 13A, 13B, by means of pivot pins 31A, 31B to two opposite sides of the upper part of toy body 10. Each hand 18A (18B) is also provided with a ski pole 14A (14B) at the free end, as if the skier were holding a pair of ski poles with his hands. Built within toy body 10 are a driving mechanism operable by an electric motor 20 to operate driving wheels 15A, 15B, and an alternating device 22 for alternatingly moving two hands 18A, 18B. As shown in FIGS. 2 and 3, the driving mechanism includes a first reduction gear set 21 consisting of first gear B, second gear C, third gear D, fourth gear E, fifth gear F; and a pair of vertical drive shafts 32A, 32B for transmitting the rotary power from the first reduction gear set 21 to driving wheels 15A, 15B. The alternating device 22 includes a pivot lever 25, second reduction gear set 21A and a connecting rod 24 for transmitting the power from electric motor 20 to pivot lever 25. Second reduction gear set 21A includes a worm gear R coaxially connected to fourth gear E, and a worm wheel W engaging with worm gear R; worm wheel W is operatively connected to pivot lever 25 by a connecting rod 24 having one end pivotally and eccentrically mounted onto boss V of worm wheel W and another end pivotally connected onto pivot lever 25. Pivot lever 25 is pivotally mounted onto a structural part of toy body 10 by pivot pin 28, and has two ends respectively inserted into the upper part 13A, 13B of two hands 18A, 18B, adjacent to pivot pins 31A, 31B. When worm gear R rotates, worm wheel W is caused to rotate and the rotary motion of worm wheel W is converted to a reciprocating motion by connecting rod 24 to cause pivot lever 25 to pivot alternatingly with respect to pivot pin 28, thus causing two hands 18A, 18B to move around pivot pins 31A, 31B alternatingly, causing their free ends to move up-and-down alternatingly.

Electric motor 20 has an output spindle on which a driving gear A is fixedly mounted. Driving gear A engages with first gear B of first reduction gear set 21, first gear B being fixedly mounted onto one end of a first shaft S1 rotatably supported by a frame 23 (FIG. 2). Second gear C which engages with third gear D is fixedly mounted onto another end of first shaft S1 so as to rotate with first gear B. Third gear D is fixedly mounted on one end of a second shaft S2 rotatably supported by the same frame 23 (FIG. 2), second shaft S2 also having fourth gear E and worm gear R fixedly mounted thereon so that third gear D, fourth gear E and worm gear R rotate together as one unit. Fifth gear F, which engages with fourth gear E, is fixedly mounted onto a third shaft S3 rotatably supported by frame 23 (FIG. 2), third shaft S3 having two ends on which sixth and seventh gears G and H are fixedly mounted, so that sixth and seventh gears G and H rotate with fifth gear F.

Vertical drive shafts 32A, 32B, are respectively provided with upper crown-shaped gears 33A, 33B, and lower crown-shaped gears 34A, 34B. Upper crown-shaped gears 33A, 33B are respectively fixedly mounted onto the upper ends of vertical drive shafts 32A, 32B, and engage with sixth and seventh gears G, H respectively, so as to transmit the rotary power of third shaft S3 to vertical drive shafts 32A, 32B. Lower crown-shaped gears 34A, 34B are respectively fixedly mounted onto the lower ends of vertical drive shafts 32A, 32B and engage with driving wheel gears J, K, which are respectively fixedly mounted onto driving wheel axles 36A, 36B rotatably supported at the lower ends of legs 11A, 11B. Driving wheels 15A, 15B are respectively fixedly mounted onto driving wheel axles 36A, 36B and concealed within the lower part of legs 11A, 11B, with the lower part of driving wheels 15A, 15B extending downwardly through slots 35A, 35B formed in skis 15A, 15B to enable driving wheels to roll on the ground surface. Vertical drive shafts 32A, 32B, are rotatably supported within legs 11A, 11B, of toy body 10.

Toy body 10 is provided with a head 30 having a neck part 30A pivotally mounted by means of hinge pin 30B on the upper part of toy body 10, the head 30 being capable of tilting in two sideward directions with respect to hinge pin 30B. A link 26 is provided to connect one edge of neck part 30A of head 30 with pivot lever 25, so that when pivot lever 25 is caused to pivot alternatingly around pivot pin 28, head 30 is also caused to tilt sidewards alternatingly.

Figure 4:
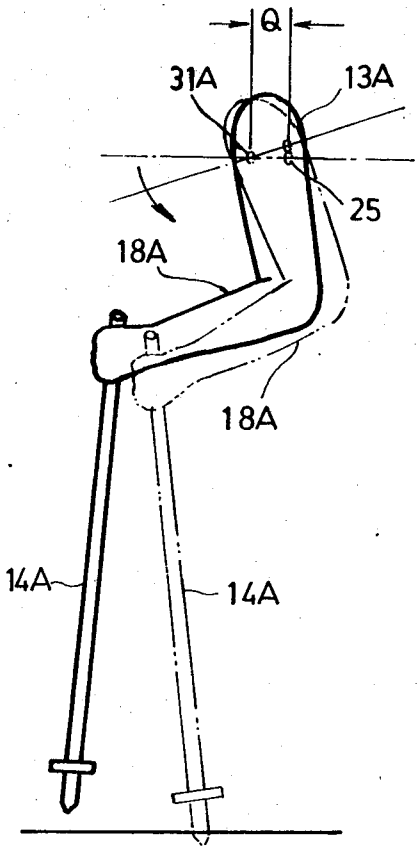
FIG. 4 is a schematic illustration showing the principles of operation of the L-shaped hand and the ski pole of the toy of this invention.
Figures 6, 7, 8:
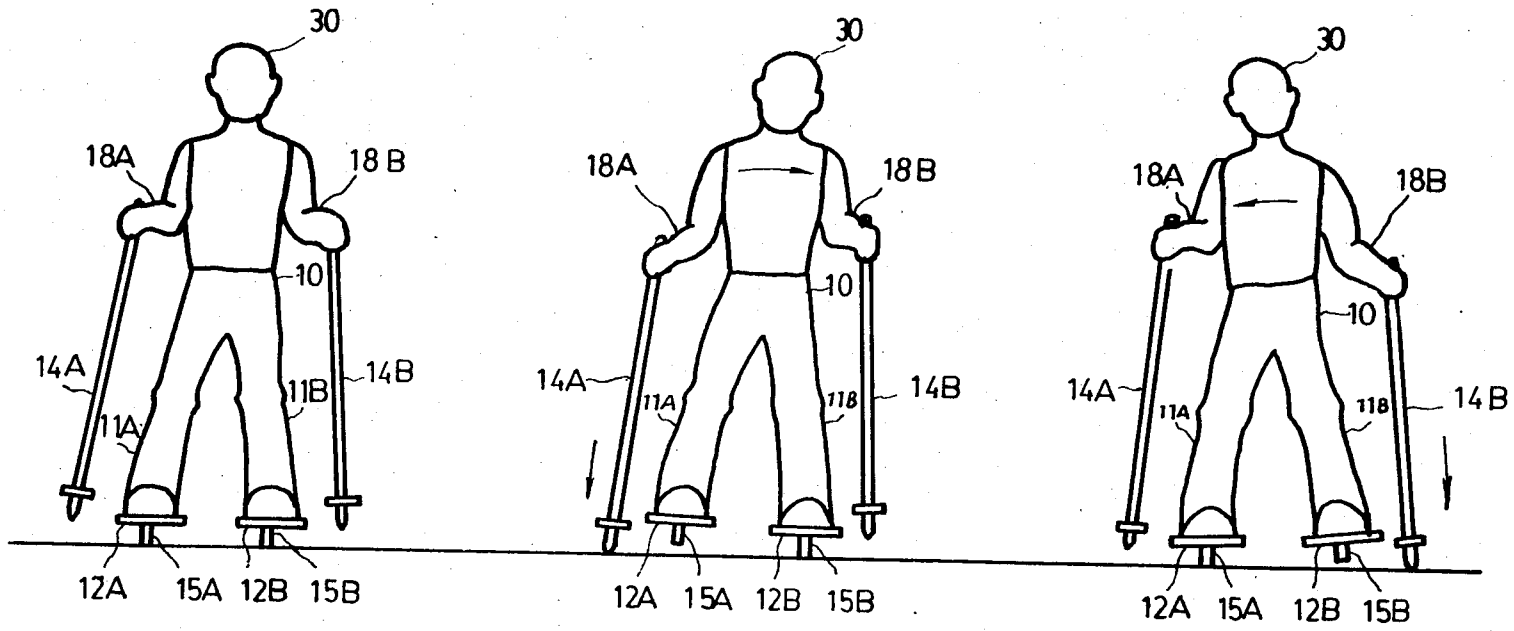
FIG. 6 is a schematic rear view of the skiing toy of FIG. 1, with both ski poles lifted from the ground surface to allow the toy to roll straight.
FIG. 7 is a schematic rear view of the skiing toy of FIG. 1, with a first ski pole pushing the ground surface while a second ski pole remains lifted from the ground surface to cause the toy to turn in one direction.
FIG. 8 is a schematic rear view of the skiing toy of FIG. 1, with the second ski pole moved down to push the ground surface while the first ski pole is lifted, to cause the toy to turn in an opposite direction.

Pivot lever 25, as described above, has two ends respectively extending into the upper part 13A, 13B of respective hands 18A, 18B, the two ends being generally on the same level with pivot pins 31A, 31B when pivot lever 25 is at generally horizontal position L0—L0 as shown in solid lines in FIG. 5, with the end part of pivot lever 25 disposed a distance Q apart from pivot pin 31A as shown in FIG. 4. 25 When pivot lever 25 is generally at horizontal position L0—L0, two hands 18A, 18B are at the same level and the lower ends of two ski poles 14A, 14B are slightly above the ground surface, as shown in FIG. 6. When pivot lever 25 is caused to pivot and tilt in one direction to position L1—L1 as shown in brocken lines in FIG. 5, one end M moves up and another end N moves down. The end M which moves up causes the respective hand, for example, left hand 18A, to rotate counter clockwise with respect to pivot pin 31A, as shown in brocken lines in FIG. 4, so as to cause ski pole 14A of left hand 18A to move downwardly to push the ground. As a result toy body 10 is caused to tilt toward the right hand side and the ski 12A of the same side of the down-moving hand 18A with the driving wheel 15A on that ski 12A is caused to lift from the ground as shown in FIG. 7, while the ski pole 14B of the opposite side is caused to move upwardly to keep driving wheel 15B of ski 12B of the opposite side on the ground.

The toy is further provided with a sound device 40, a battery (not shown) for supplying electric power to electric motor 20, and a switch (not shown) for turning on and turning off electric motor 20.

The operation of the skiing toy of this invention will now be described.

As soon as electric motor 20 is turned on, gears A, B, C, D, E, F, G and H are caused to rotate, so that the rotary power from electric motor 20 is transmitted through first reduction gear set 21 to vertical drive shafts 32A, 32B through upper crown-shaped gears 33A, 33B, and further to driving wheels 15A, 15B, through lower crown-shaped gears 34A, 34B, and driving wheel gears J, K. The skiing toy will thus roll ahead on the ground surface. At the same time pivot lever 25 is driven by worm gear R, worm wheel W and connecting rod 24 to pivot alternatingly with respect to pivot pin 28, causing the two ends of pivot lever 25 to move up and down alternatingly. When pivot lever 25 is generally at horizontal position, two hands 18A, 18B of the skiing toy are both at generally the same level and the lower ends of two ski poles 14A, 14B are both slightly above the ground surface to allow the toy to roll along a straight course, as shown in FIG. 6.

As soon as one end, e.g., the left hand side end of pivot level 25 moves upwardly, left hand 18A is caused to rotate counter clockwise (FIG. 4), thus causing the free end of left hand 18A to move down. As a result ski pole 14A of left hand 18A is moved downwardly to push the ground while the toy is rolling ahead. Consequently the toy body 10 is caused to tilt towards the right hand side and ski 12A of left leg 11A is lifted from the ground surface as shown in FIG. 7. At this instance the toy is rolling forward on driving wheel 15B of right leg 11B, with ski pole 14A pushing the ground, so as to cause the toy to turn leftwardly.

As soon as pivot lever 25 has completed one half of its pivoting cycle and its left hand side end rises, its opposite end or right hand side end moves downwardly, ski pole 14B of right hand 18B is caused to move downwardly so as to push the ground, and toy body 10 is caused to tilt towards the left hand side as shown in FIG. 8. As a result the toy is caused to roll on the driving wheel 15A of left leg 11A, to make a right turn.

In between each two half cycles of the pivoting movement of pivot lever 25, there is an instant in which pivot lever is at a horizontal position to align both ends at the same level; in such instance the toy rolls straight ahead.

Therefore, the toy rolls continuously along a course having a first turn, then along a straight course, and then an second opposite turn, and then again along a straight course, and so on, so as to perform a motion which is full of fun, as if a skier were skiing along a zig-zag course.

When electric motor 20 is turned on, the rotary power of electric motor 20 is transmitted to pivot lever 25 which is thus caused to pivot alternatingly with respect to pivot pin 28, and the pivot lever 25 causes head 30 of the toy to move alternatingly sidewardly. As the movement of head 30 is caused by the same pivot lever 25 which causes the toy to make a turn, head 30 moves in one direction when the toy makes a turn in one direction, and moves in another direction when the toy makes a turn in another direction; in other words, head 30 moves synchronously in cooperation with the toy's turning movement, so that the toy performs as if the skier were enjoying skiing.

Furthermore, when electric motor 20 is turned on, sound device 40 is also turned on to produce a preselected melody, so as to make the performance of the toy more joyful.

While a preferred embodiment of the skiing toy of this invention has been described and illustrated, it should be understood that modifications are possible without departing from the spirit and scope of this invention as defined by the appended claims.

What is claimed is:

1. A toy comprising:

an upright toy body having two legs each standing on an elongated flat member resembling a ski and each leg having a driving wheel to enable the toy to roll on a flat ground surface and two L-shaped arms each holding an elongated rod resembling a ski pole, each of said arms having an upper part pivotally connected by means of a pivot pin to an upper side of said toy body and capable of making a pivotal movement relative to said toy body;

a driving mechanism within said toy body and operable by an electric motor to cause said driving wheels to rotate; and an alternating device carried by said toy body, said alternating device including a reduction gear set operable by said electric motor, a pivot lever pivotally mounted within said toy body, and a connecting rod which connects said reduction gear set and said pivot lever to transform rotary motion of said reduction gear set to a reciprocal motion causing said pivot lever to pivot alternating, said pivot lever having two ends with each end respectively extending into said upper part of one of said arms for causing said arms to move alternatingly around their respective pivot pins when said pivot lever is caused to pivot alternatingly;

whereby said poles are caused to alternatingly push the ground causing said upright toy body to tilt sidewardly and the two driving wheels of said skies to alternately lift from the ground and move said toy along a zigzag course.

2. The toy as recited in claim 1, wherein said toy body is provided with a head pivotally mounted on an upper part of said toy body and operatively connected to said pivot lever to pivot alternating sidewardly synchronously with the movement of said arms.

* * * * *